US005517712A

United States Patent [19]

Schiano

[11] Patent Number: 5,517,712

[45] Date of Patent: May 21, 1996

[54] PORTABLE TOOTHBRUSH AND MOUNTING STAND

[76] Inventor: Travis A. Schiano, 12 Dorothy La., Kings Park, N.Y. 11754

[21] Appl. No.: 315,873

[22] Filed: Sep. 29, 1994

[51] Int. Cl.[6] ..... A46B 9/04; A45D 44/18

[52] U.S. Cl. ..... 15/167.1; 15/257.01; 211/65; 248/110; 132/309

[58] Field of Search ..... 15/167.1, 257.01, 15/176.1, 176.4, 167.2, 106, 160, 159.1; 211/65; 248/110, 111, 112, 113; 132/309, 308

[56] References Cited

U.S. PATENT DOCUMENTS

| | | | |
|---|---|---|---|
| 1,488,214 | 3/1924 | Mason | 132/309 |
| 1,728,956 | 9/1929 | Darmitzel | 132/309 |
| 1,908,510 | 5/1933 | Dodson | 15/176.4 |
| 2,172,591 | 9/1939 | Peterson | 132/309 |
| 2,787,072 | 4/1957 | Vogel | 248/110 |
| 3,103,680 | 9/1963 | Krichmar | 15/167.1 |
| 3,968,950 | 7/1976 | Gallo | 15/167.1 |
| 4,457,039 | 7/1984 | Massari | 15/167.1 |
| 4,770,379 | 9/1988 | Estvold | 248/110 |
| 4,987,910 | 1/1991 | Lowe | 15/167.1 |
| 4,995,515 | 2/1991 | Smith | 211/65 |
| 5,297,677 | 3/1994 | Burian et al. | 248/110 |

*Primary Examiner*—Gary K. Graham
*Attorney, Agent, or Firm*—Alfred M. Walker

[57] ABSTRACT

A portable oral hygiene tool includes an ergonomically formed toothbrush for comfort, control and ease of use, encompassing a toothbrush body having a bristle head portion to accommodate changeable and renewable bristles to be discarded when they are past their time of effectiveness and to maintain the toothbrush sanitarily and hygienically. It also accommodates various sized bristles and firmness.

1 Claim, 3 Drawing Sheets

PORTABLE TOOTHBRUSH AND MOUNTING STAND

BACKGROUND OF THE INVENTION

The present invention relates to a portable angled mounting assembly for a toothbrush where the toothbrush bristle portion is elevated up from the surface of a sink to isolate the toothbrush from dirt, water and other contaminants, and also to a novel toothbrush bristle head.

Various types of wall mounted toothbrush holders are known. In order to isolate the toothbrush with a high degree of separation from a sink surface, apparatuses such as wall mounted shelves with groove shaped passage holes therein for insertion of the toothbrush handles therein are provided. The toothbrushes are held in place because the width of the bristle portion of a toothbrush is wider than the diameter of the hole for the handle, so that the toothbrush bristles rest upon the wall mounted shelf.

However, in the toothbrushes mounted by these shelf apparatuses, it is difficult to isolate the bristles from the shelf which contains water, particles or contaminated products therein. Moreover, often it is difficult to mount the shelves to a wall by persons with limited mechanical abilities or arthritic hand conditions.

Such existing toothbrush mounting shelves usually have a plurality of groove-shaped passages, each arranged to hold a toothbrush. The passages form an opening through the shelves and the toothbrushes are introduced through the groove-shaped passages.

The wall mounted shelf itself includes a horizontally extending plate member provided with a groove-shaped passage through-holes. The toothbrushes to be held in place are introduced through the inlets on the upper side of the shelf plate member, through the channel formed through the plate member.

In other toothbrush mounting devices, mounting is carried out by a magnetic plate to which a toothbrush with a metal strip is held.

For this reason, the wall mounted plate member is made of magnetic material. However, even the magnetic wall mount must be mounted to a wall, and is therefore not portable.

OBJECTS OF THE INVENTION

It is an object of the present invention to provide a portable toothbrush and mounting stand assembly encompassing a rest stand for inverted or upright sanitary drying of bristles.

It is another object to provide a toothbrush and mounting stand with a functional, modern, user friendly design.

It is yet another object to provide a portable, oral hygiene toothbrush which is compact and which is an all-in-one tool for all toothbrush widths and bristle sizes, and all grades of dental floss.

It is a further object to provide an oral hygiene tool to accommodate all lifestyles and needs for the maintenance and care of teeth, mouth and gums, and for general freshness and overall health.

It is another object to provide a toothbrush and mounting stand with an ergonomic design derived from its function and use to accommodate personal needs and preferences of an individual user.

It is yet another object to provide a toothbrush and mount assembly which can be constructed of a flexible, recycled plastic or rubber that can be easily sanitized in the dishwasher.

It is a further object to improve over the disadvantages of the prior art.

SUMMARY OF THE INVENTION

In keeping with these objects and others which may become apparent, the present invention provides a portable apparatus for holding a toothbrush bristle head above a sink surface. A toothbrush handle member has an angled recess portion which is arranged to fit upon a portable mounting stand wherein the portable mounting stand includes a corresponding angled protrusion portion, such as an inverted V-shaped peak, which communicates with the angled recess of the toothbrush handle peak of the mounting stand member. Therefore, the toothbrush bristle head is supported in an elevated position above a sink surface. It is isolated from the sink surface by the drying stand for an inverted hygienic drying of bristles above the sink surface.

The angled recess of the toothbrush handle is integrally formed with the toothbrush handle and the toothbrush is mounted upon the stand by overlapping the toothbrush handle upon the stand. The toothbrush handle portion, where the handle is mounted upon the stand, is designed with an angled recess and the bristle head end portion is designed to be angled upward therefrom.

The portable oral hygiene tool therefore includes an ergonomically formed toothbrush designed for comfort, control and ease of use. It encompasses a reusable bristle head which is inserted within a receptacle portion within the handle portion, to accommodate changeable and renewable bristles to be discarded when they are past their time of effectiveness and to maintain the toothbrush sanitarily and hygienically. The removable bristle head is inserted into the receptacle bristle head portion, so that the bristles can be changed when worn out. The receptacle portion also accommodates various sized bristles and firmness.

The all-in-one hygiene tool of the present invention also include a replaceable tooth floss dispenser which accommodates various widths and finishes of floss for user preferences. An orifice may be provided in the handle where a dental floss strand passes through, and a separate dental floss supply portion is mounted at one side of the orifice. The floss supply portion is opposite the recess in the toothbrush handle, which is mounted upon the stand.

Being portable, the oral hygiene tool can accommodate the users' oral hygiene needs wherever a user may go, i.e. camping, traveling, out for lunch or dinner, home, office or vacationing, where a user may not have sanitary conditions on a bathroom sink surface.

It is preferably constructed of recycled flexible plastic or rubber that can be sanitized in a dishwasher once the head, tooth floss and cutter are removed.

Thus, the bristles may be elevated from touching the surface of the restaurant or motel sink. By forming a toothbrush handle with an angled recess, it is possible to support a toothbrush above a sink surface, wherein bristles will not be contaminated by the sink surface.

BRIEF DESCRIPTION OF THE DRAWINGS

The invention can best be described in conjunction with the accompanying drawings in which.

DETAILED DESCRIPTION OF THE DRAWINGS

As shown in FIGS. 1–7, the toothbrush mount assembly of the present invention includes a toothbrush body 10 having a handle portion 10*a* and a bristle head support portion 10*b*.

A separable free standing mounting stand 20 supports toothbrush body 10 above a sink surface. Toothbrush body 10 includes a mounting recess 10*c* formed by two oblique members 10*d* and 10*e* which converge at common peak 10*f*. Recess 10*c* sits between handle portion 10*a* and bristle head support portion 10*b*.

Figure 2A:
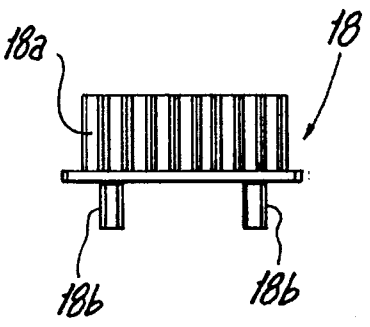
FIG. 2A shows detailed side elevational view of the bristle assembly unit.
Figure 2B:
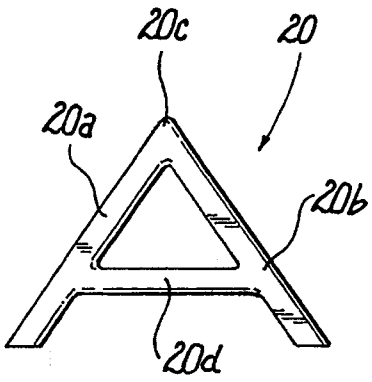
FIG. 2B is a side elevational view of the mounting stand of the assembly as in FIG. 1.
Figure 2:
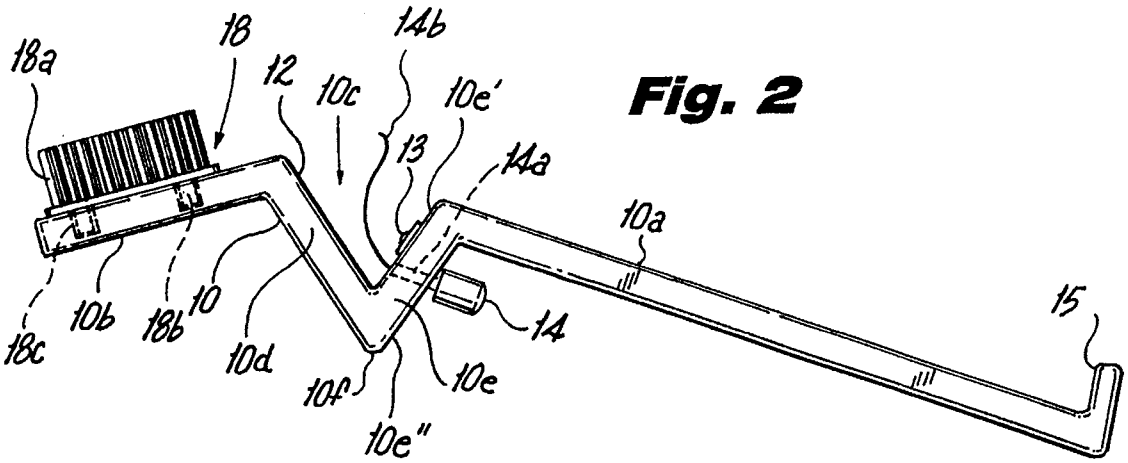
FIG. 2 is a side elevational view of the toothbrush portion of the assembly of the present invention as in FIG. 1.
Figure 1:
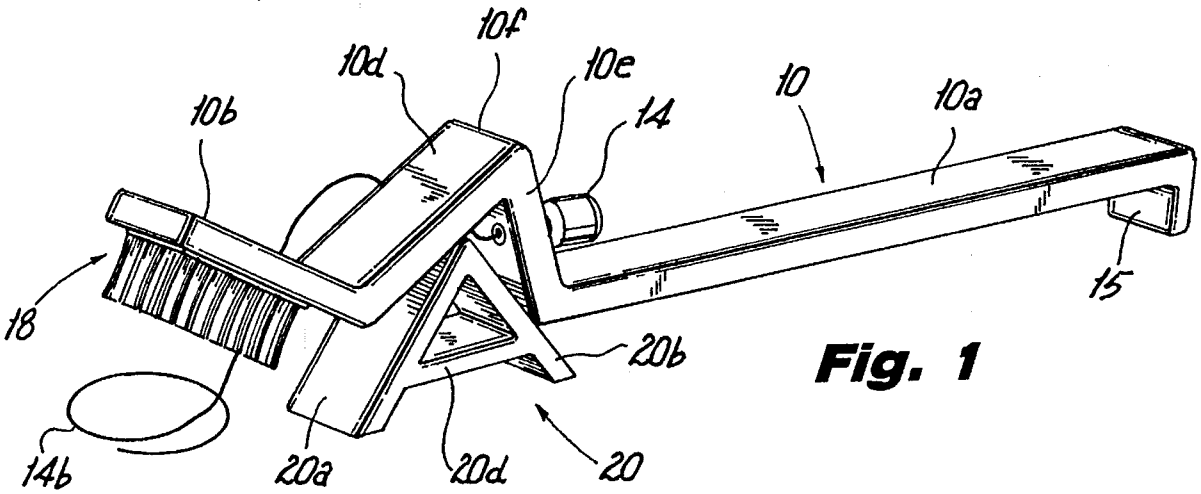
FIG. 1 is a perspective view of a portable toothbrush and mounting assembly of the present invention.
Figure 3:
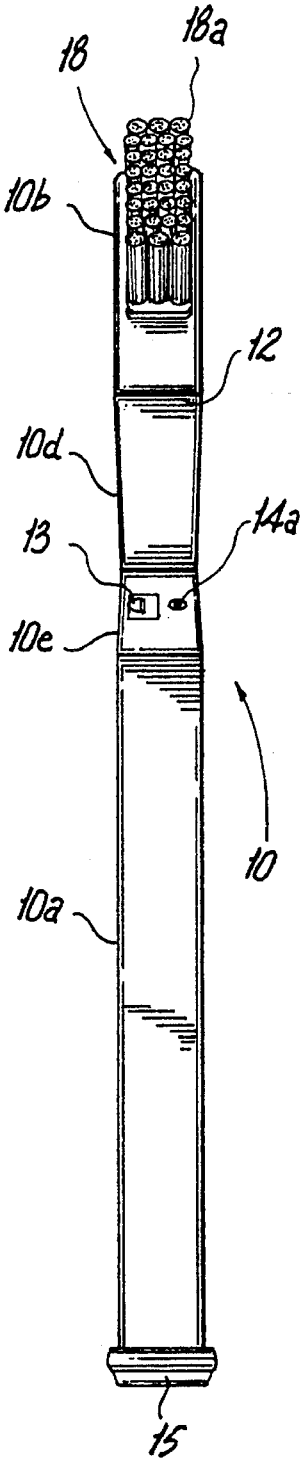
FIG. 3 is a bottom view of the toothbrush portion of the assembly in FIG. 1.
Figure 4:
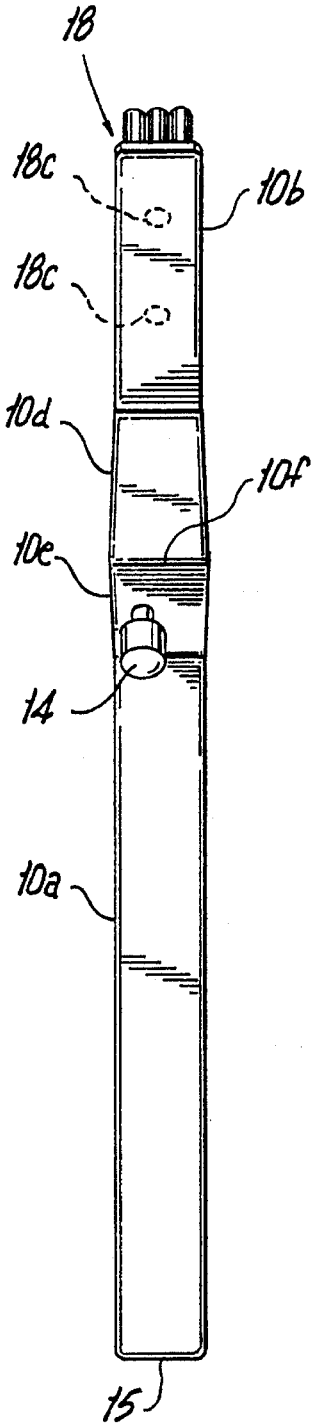
FIG. 4 is a top plan view of the toothbrush portion of the assembly as in FIG. 1.
Figure 5:
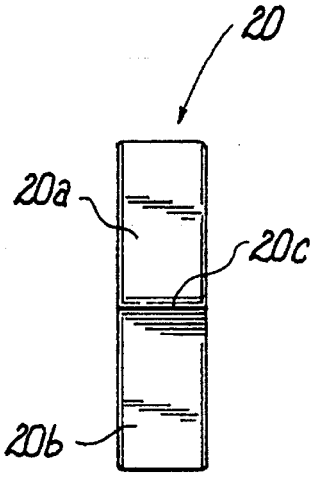
FIG. 5 shows a top plan view of the mounting stand of the assembly according to the present invention as in FIG. 1.
Figure 6:
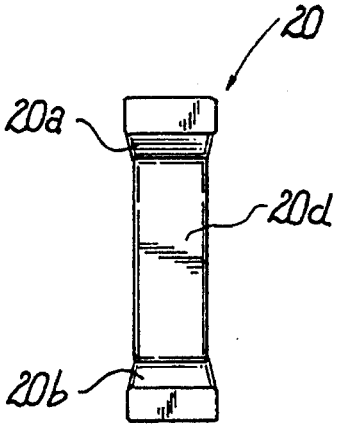
FIG. 6 shows a bottom plan view of the mounting stand of the assembly as in FIG. 1.
Figure 7:
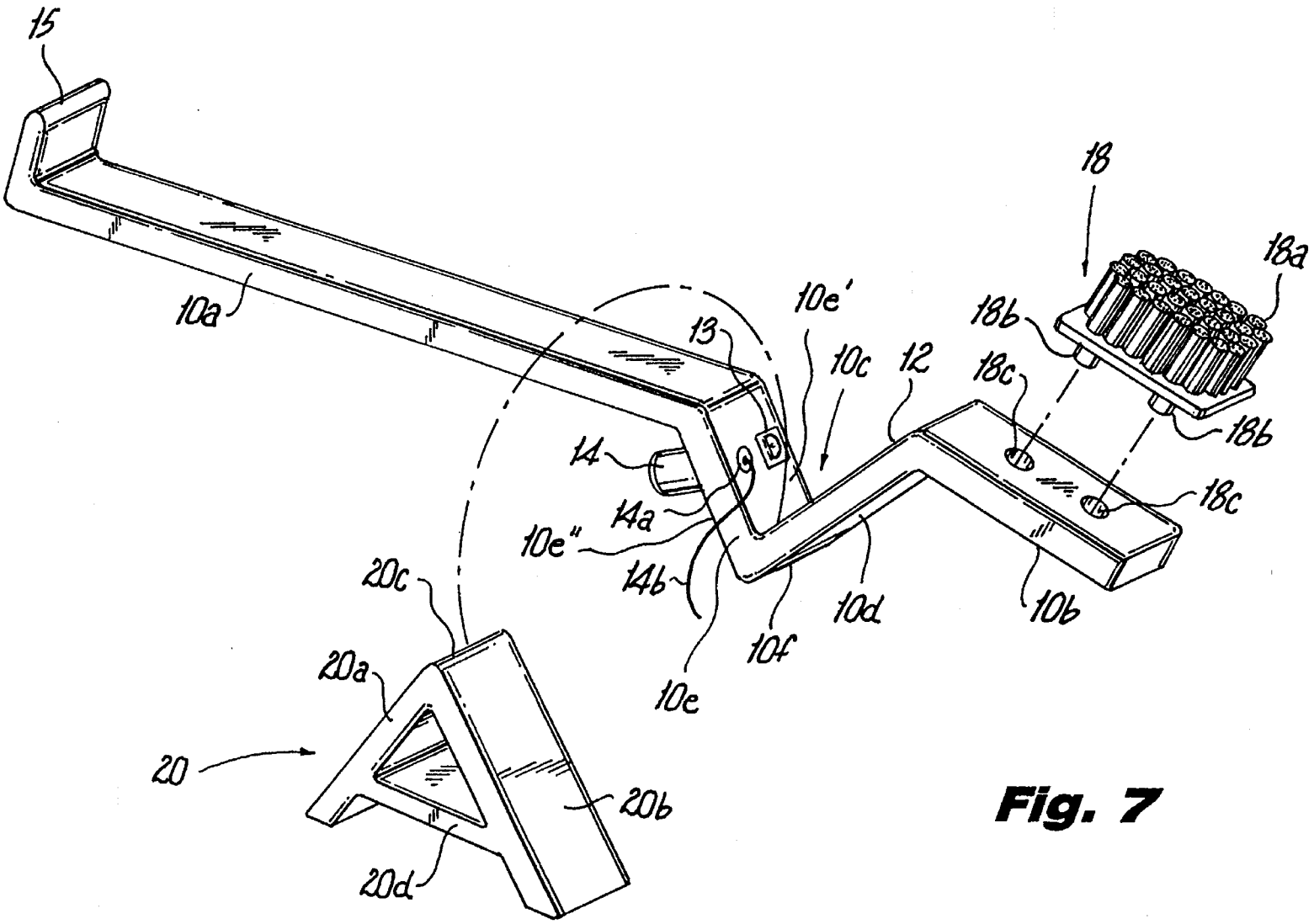
FIG. 7 shows an exploded perspective view showing the removable bristle portion and a dental floss strand, with the toothbrush shown in an inverted position.

Toothbrush body 10 is removably mountable upon separable mounting stand 20, for isolating bristles 18*a* of bristle head 18 in spaced relation away from a sink or other surface upon which mounting stand 20 sits. Separable mounting stand 20 includes two upwardly oblique converging support members 20*a* and 20*b*, which converge at peak 20*c* and are joined below peak 20*c* by cross brace 20*d*. As shown in FIGS. 1, 5 and 7, peak 20*c* has an uninterrupted continuous edge, extending along the length of peak 20*c* and toothbrush body 10 is mountable, directly upon uninterrupted continuous peak 20*c* of mounting stand 20, at peak 10*f*, which peak 10*f* is formed by oblique members 10*d* and 10*e* having mounting recess 10*c* therebetween.

Bristle head 18 of toothbrush body 10 includes a set of bristles 18*a* which can be replaced when worn out. Bristle head 18 is removably mountable upon bristle head support portion 10*b* of toothbrush body 10 by means of at least one post 18*b* insertable within a corresponding post receiving groove 18*c* of bristle head support portion 10*b* of toothbrush body 10.

For ease of handling, surface 12 of oblique member 10*d* provides a thumb surface for the user's thumb.

An optional slidable tooth floss cutter edge 13 is mounted upon a first side 10*e'* of oblique member 10*e*, which oblique member 10*e* has an opposite side 10*e"* to which is mounted an optional central floss dispenser 14.

Tooth floss opening 14*a* communicates between floss dispenser 14 and tooth floss cutter 13 for insertion of dental floss 14*b* therethrough.

When in place upon mounting stand 20, toothbrush 10 also rests upon a sink surface by placement of end 15 upon a sink surface. End 15 extends from handle portion 10*a* at an end opposite from bristle head portion 18.

Thus, bristles 18*a* may be elevated up from the surface of a sink. Therefore it is possible to mount toothbrush 10 in a position such that bristles 18*a* will not be contaminated by the sink surface.

It is understood that other modifications may be made to the present invention without departing from the scope of the appended claims.

I claim:

1. In combination, a toothbrush and a mounting stand, said mounting stand for supporting said toothbrush above a surface;

said toothbrush comprising;

an elongated body having opposed first and second sides along its length, said body having a handle portion at a first end and a bristle head support portion at a second end, said bristle head support portion having at least one groove located in said first side, said handle portion having a laterally projecting end extending from said first side, said elongated body further comprising first and second obliquely extending flat members, intermediate said ends, converging to form a first peak and forming a recess therebetween, said first and second flat members converging at a first predetermined angle and each said flat member having opposed first and second planar surfaces, said first flat member having an aperture extending therethrough, an interchangeable bristle head having a plurality of bristles, said bristle head having at least one post thereon removably inserted within said at least one groove of said bristle support portion, a dental floss dispenser, housing a supply of dental floss therein, mounted on the first planar surface of said first flat member, said dental floss having a portion thereof extending through said aperture, a dental floss cutter mounted on the second planar surface of said first flat member and adapted to cut said dental floss passing through said aperture, said mounting stand comprising;

third and fourth obliquely extending members converging to form a second peak and forming a recess therebetween, said third and fourth members converging at a second predetermined angle that corresponds to said first predetermined angle, said second peak for supporting said toothbrush body wherein said second peak is received into said recess.

* * * * *